United States Patent [19]

Miyamoto et al.

[11] Patent Number: 4,662,406

[45] Date of Patent: May 5, 1987

[54] CONTROLLER FOR AN AUTOMATIC REPAIR UNIT WHICH CORRECTS ABNORMAL WEAVING OPERATION ON A LOOM

[75] Inventors: Osamu Miyamoto; Tsutomu Sainen, both of Ishikawa, Japan

[73] Assignee: Tsudakoma Kogyo Kabushiki Kaisha, Japan

[21] Appl. No.: 765,256

[22] Filed: Aug. 13, 1985

[30] Foreign Application Priority Data

Aug. 16, 1984 [JP] Japan ..... 59-171207

[51] Int. Cl.[4] ..... D03D 51/00

[52] U.S. Cl. ..... 139/1 R; 139/336; 139/370.2

[58] Field of Search ..... 139/336, 1 R, 1 E, 370.1, 139/370.2

[56] References Cited

U.S. PATENT DOCUMENTS 4,178,969 12/1979 Gotoh et al. ..... 139/336 X
4,503,889 3/1985 Van Mullekom .
4,525,787 6/1985 Tzvetkov ..... 139/1 R
4,529,010 7/1985 Harts ..... 139/1 R
4,546,263 10/1985 Gotoh et al. ..... 139/370.2
4,565,224 1/1986 Keller ..... 139/370.2
4,573,499 3/1986 Sugita et al. ..... 139/370.2

FOREIGN PATENT DOCUMENTS 58-220856 12/1983 Japan .
59-156097 7/1984 Japan .
59-170757 8/1984 Japan .
59-216948 12/1984 Japan ..... 139/1 E
59-216956 12/1984 Japan ..... 139/1 R

*Primary Examiner*—James Kee Chi
*Attorney, Agent, or Firm*—Ostrolenk, Faber, Gerb & Soffen

[57] ABSTRACT

Practice of an auto-repair operation on a loom is automatically prohibited when the frequency of auto-repair operation exceeds a preselected rate in order to avoid production of off-grade cloths otherwise caused by continuously repeated formation of weaving defects.

10 Claims, 3 Drawing Figures

CONTROLLER FOR AN AUTOMATIC REPAIR UNIT WHICH CORRECTS ABNORMAL WEAVING OPERATION ON A LOOM

BACKGROUND OF THE INVENTION

The present invention relates to a controller for an automatic repair unit (hereinafter auto-repair unit) which corrects abnormal weaving operates on a loom. More particularly, the present invention relates to a controller which is capable of prohibiting operation of an auto-repair unit when the frequency of auto-repair operations has exceeded a preselected limit.

As used herein, the term "production index" refers to a value indicative of the quantity of cloth produced by the loom. Production time, the number of weft insertions which have taken place during production, and the length of cloth produced are examples of such a production index. As used herein, the term "present production index" shall refer to a predetermined production index during which a determination is made as to whether the rate of auto-repair operations, and therefore the rate of weaving defects is acceptable. The term "production period" shall refer to the time it takes for the production index to reach the preset production index.

When an abnormal weaving operation has started on a loom, an auto-repair unit operates to arrange a situation suited for restarting the loom. One typical example of such an auto-repair unit is a faulty weft remover unit. When abnormal weft insertion has started on a loom and loom crank rotation has been stopped, the loom crank is rotated over almost one cycle in a direction opposite to the normal direction of the loom in order to open the shed of the faulty weft and release the faulty weft. Next a faulty weft remover unit operates to remove the faulty weft from the open shed.

One example of such a faulty weft remover unit is disclosed in Japanese Patent Opening No. Sho. 58-220856. The assignee of this application has proposed some examples of such a faulty weft remover unit in Japanese Patent Applications No. Sho. 59-156097 and No. 59-170757.

On receipt of a detection signal indicating an abnormal weft insertion, the faulty weft remover unit automatically operates to remove a faulty weft from its shed. Neither manual labor nor manual discrimination is involved in this removal of the faulty weft. Other types of auto-repair units operate on the same principle and in the same fashion.

Some types of abnormal weaving are likely to repeat continuously when the source of trouble is not removed. Abnormal weft insertion caused by abnormal shedding is one typical example. Repeated abnormal weaving operation tends to enlarge weaving defects despite the operation of the auto-repair unit and seriously deteriorates the cloth produced. The presence of apparent or enlarged defects on a cloth lowers its grade seriously.

At the beginning of an auto-repair operation, the auto-repair unit starts its operation on receipt of a detection signal indicative of the presence of abnormal weaving operation without regard to the source of the trouble. Such an abnormal situation may be detected by an operator when the production is under even partial manual control. In the case of fully automatic control of the production, however, such an abnormal situation cannot be detected and, as a consequence, operation of the auto-repair unit is repeated continuously until the production itself ends. Thus, weaving defects initially caused by the abnormal weaving are cumulatively enlarged to significantly degrade the cloth produced even below C-grade.

SUMMARY OF THE INVENTION

It is the object of the present invention to avoid enlargement of defects caused by abnormal weaving operations when an auto-repair unit is employed, thereby reducing production of off-grade cloth.

In accordance with a basic aspect of the present invention, an auto-repair signal is generated upon every auto-repair operation, the auto-repair signals are sequentially counted to produce count values which are compared with a selected acceptable auto-repair value and, when the count value equals the selected acceptable auto-repair value within a preselected production index, an alert signal is issued to prohibit further auto-repair operations.

Detection of the real increase in production index may be started either from the beginning of production or from the first auto-repair operation after resetting of the first counter.

DESCRIPTION OF THE PREFERRED EMBODIMENTS

As stated above, the controller in accordance with the present invention operates basically as a function of the occurrence of auto-repair operations. However, when the present invention is applied to a system in which loom crank rotation is always stopped when there is an abnormal weaving operation, the controller may be designed to operate as a function of the stoppage of loom crank rotation. Application to abnormal weft insertion is one example of that type.

Figure 1:
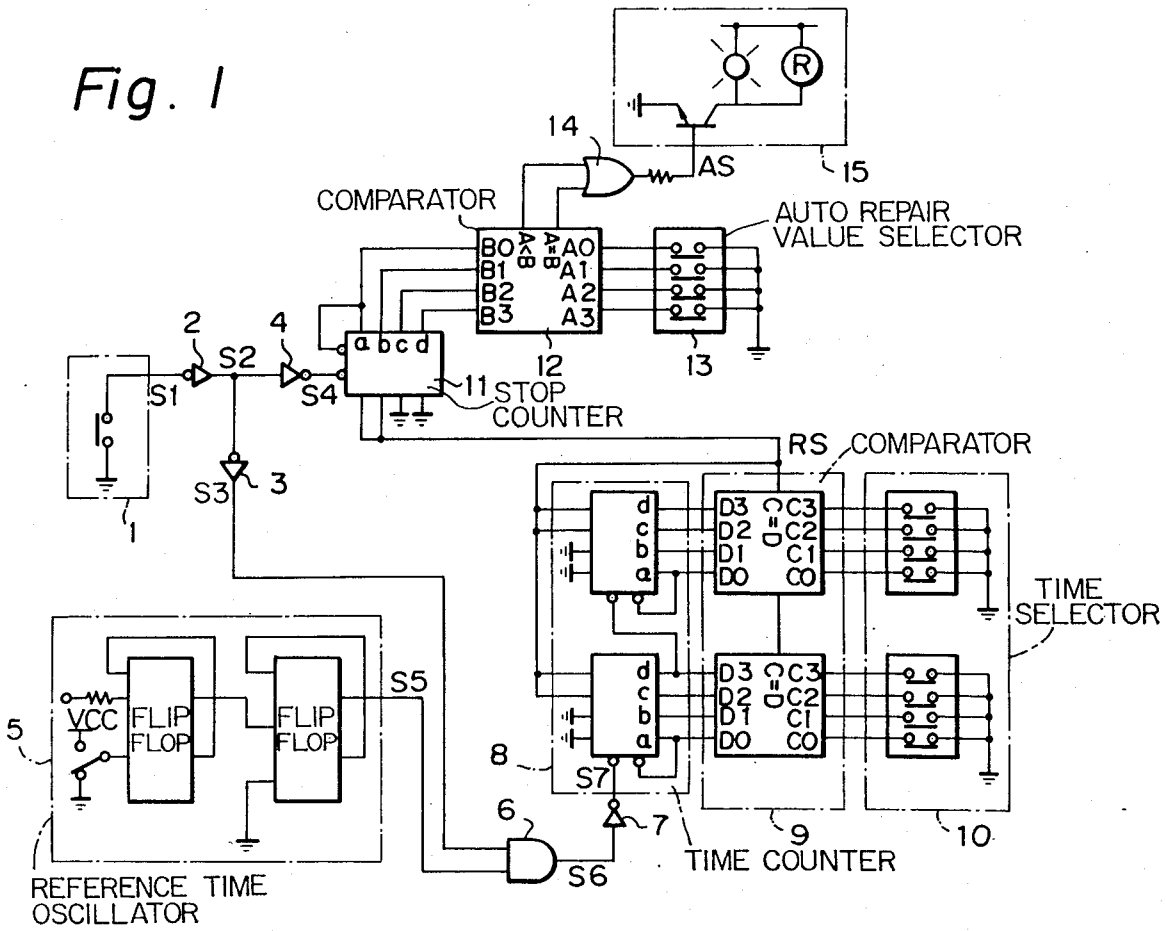
FIG. 1 is a block diagram of the first embodiment of the controller in accordance with the present invention.

In the system shown in FIG. 1, the production index of the loom is measured from the beginning of production.

The controller includes an auto-repair control circuit 1 which generates an auto-repair signal S1 every time an auto-repair operation is carried out by an auto-repair unit (not shown). During the dwell period of the auto-repair unit, the auto-repair signal is maintained at high level. The auto-repair signal is shifted to the low level every time the auto-repair unit starts and stays low until it completes its operation.

The auto-repair signal S1 is converted to a signal S2 by passage through the first inverter 2 and the inverted signal S2 is converted to a signal S3 by passage through the second inverter 3. The inverted signal S3 is then passed to one input terminal of an AND-gate 6. The other input terminal of the AND-gate 6 receives clock pulses S5 at preselected intervals from a reference time oscillator 5. In the case of the illustrated example, the reference time oscillator 5 includes a pair of flip-flops which divide the commercial line frequency (AC3 V, 50/60 Hz). As an alternative, however, a crystal may be used for generation of the clock pulses S5. The output signal S6 of the AND-gate 6 is converted to a signal S7 by passage through an inverter 7 and the signal S7 is applied to a time counter 8.

The time counter 8 counts the signals S7 sequentially and passes each count value D to a comparator 9. Since production time is used in the present example as the production index, a time selector 10 is connected to the comparator 9. In the case of the illustrated example, production time (the preset production index) is selectable stepwise by switch operation. In a modification, linear selection of production time is employable. In practice, however, stepwise selection works well.

When the count value D equals the preselected production time C (i.e., at the end of the production period), the comparator 9 issues a reset signal RS which is passed to the reset terminal of the time counter 8 to the time counter. The reset signal RS is also passed to the reset terminal of a stop counter 11 to reset the stop counter.

The inverted signal S2 is changed to a signal S4 by passage through the third inverter 4 and the signal S4 is passed to the stop counter 11. The stop counter 11 counts the signals S4 and passes its count values B sequentially to a comparator 12 which is connected to an auto-repair value selector 13. The auto-repair value selector 13 is used to set an unacceptable auto-repair value stepwise by proper switching operation. When the count value B equals a selected unacceptable auto-repair value A, the comparator 12 issues an alert signal AS indicating that an unacceptable rate of auto-repair operations, and therefore an unacceptable number of weaving defects, has occurred during the present production period.

In the case of the illustrated example, the output side of the comparator 12 is connected to an OR-gate 14 so that an alert signal AS should be issued when the count B equals or exceeds the selected acceptable auto-repair value A. This is for fail-safe purposes and the OR-gate 14 may be omitted in a simpler example.

On receipt of this alert signal AS, an auto-repair prohibit circuit 15, connected to the comparator 12, prohibits further auto-repair operations, and, preferably, provides a appropriate visible indication of the situation for operators.

Figure 2:
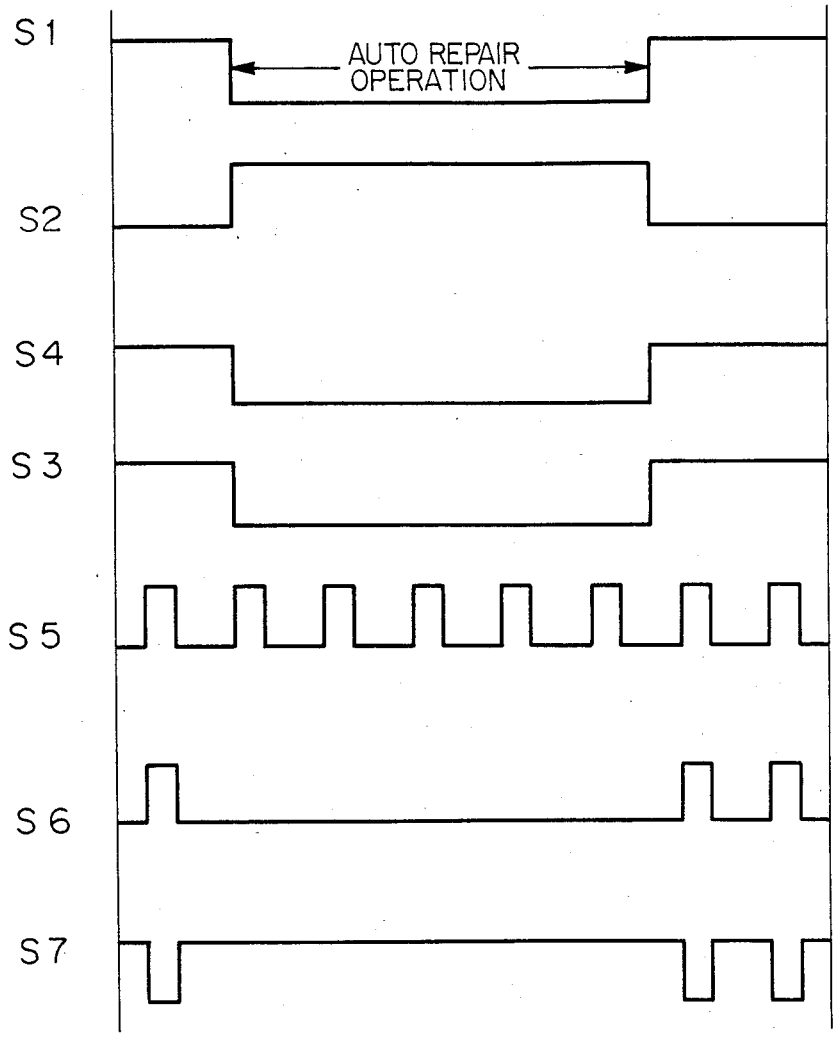
FIG. 2 is a timing diagram of various signals processed in the controller shown in FIG. 1.

Operation of the controller will now be explained in sequence in reference to the graph in FIG. 2.

As long as normal weaving is continued the auto-repair signal S1 from the auto-repair control circuit 1 is maintained at a high level. The signal S4 applied to the stop counter 11 is also maintained at high level and the count in stop counter 11 does not increase. In the mean time, clock pulses S5 is issued periodically by the reference time oscillator 5. Since the signal S3 from the second inverter 3 is kept at a high level, the timing signals S5 are passed to the time counter 8 as input signals S7 and are counted by time counter 8. Due to this counting operation, time advances within the controller concurrently with advance of the real time. The count in stop counter 11 increases by one in response to each auto-repair operation and is cleared by the reset signal RS each time the production index reaches the predetermined level.

When an abnormal weaving operation occurs and the auto repair-unit has started an auto-repair operation, the auto-repair signal S1 from the auto-repair control circuit 1 shifts to the low level and the input signal S4 to the stop counter 11 also shifts to low level. As a result, the count in stop counter 11 increases by one. In the mean time, the reference time oscillator 5 continues to issue the clock pulses S5. Due to the low level condition of the signal S3 from the second inverter 3, the input signal S7 to the time counter 8 shifts to and remains at the high level so that the time counter 8 interrupts its counting operation. That is, advance of time is interrupted within the controller despite continued advance of the real time. In other words, the production index cannot increase during the abnormal weaving operation.

When normal weaving is restarted after the completion of the auto-repair operation, the signals all resume the initial states during normal weaving, the count in stop counter 11 remains consistent, the time counter 8 restarts its counting operation and time again advances within the controller concurrently with advance of the real time.

Thus within the controller in accordance with the present embodiment, time advances concurrently with advance of the real time during normal weaving operations but stops when an abnormal weaving operation occurs (i.e., during the auto-repair operation). The count in stop counter 11 is indicative of the number of auto-repair operations during the present production time period and thereby provides an indication of frequency of weaving defects in the cloth being produced.

Weaving on the loom advances repeating the above-described process. As long as the count value B does not equal or exceed the selected unacceptable auto-repair value A before the end of the selected production time (at the end of the preset production period) the reset signal RS from the comparator 9 resets the time counter 8 and the stop counter 11. In this case, the controller determines that weaving can be continued with this rate of formation of weaving defects.

When the count value B equals the selected unacceptable auto-repair value A before the end of the selected production time at which the count value D falls short of the production time C at the comparator 9, the alert signal AS from the comparator 12 activates the auto-repair stop circuit 15 to prohibit further auto-repair operations. In this case, the controller determines that weaving should not be continued because the rate of formation of weaving defects is too high. Resetting of the counters 8 and 11 may be effected either manually or by input of the alert signal AS from the comparator 12 to the counter reset terminals. In the latter case, a suitable memory is advantageously used for storing issuance of the alert signal AS.

Figure 3:
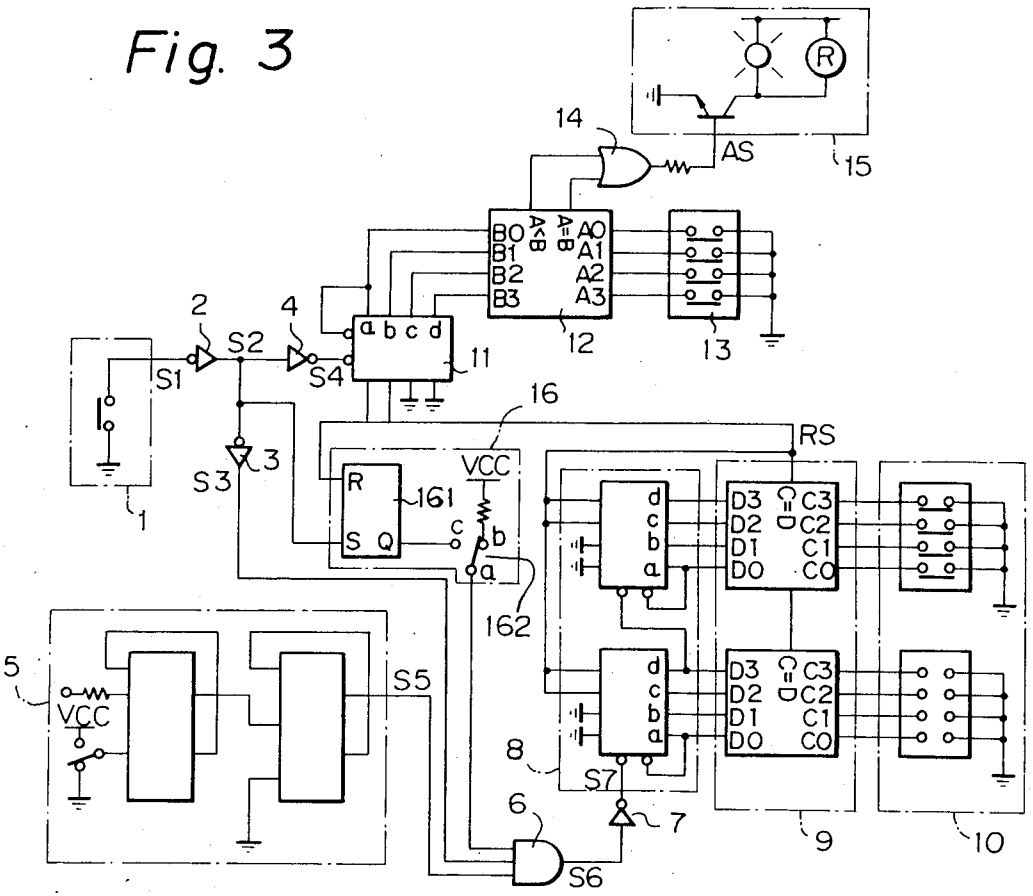
FIG. 3 is a block diagram of the second embodiment of the controller in accordance with the present invention.

In the system shown in FIG. 3, detection of the real increase in production index is started from the first practice of an auto-repair operation after resetting of the time counter 8 rather than from the beginning of loom operation as in the embodiment of FIG. 1.

In addition to the elements of the controller shown in FIG. 1, the controller of this embodiment includes a counter input control circuit 16 which contains a flip-flop 161 and a manual switch 162. The reset signal RS from the comparator 9 is passed to the reset terminal R of the flip-flop 161 and the signal S2 from the auto-repair control circuit 1 is passed to the set terminal S of the flip-flop 161. The output terminal of the manual switch 162 is connected to the AND-gate 6.

As long as the switch 162 is set to the terminal b, a high level signal is passed to the AND-gate 6 and, as a consequence, the controller operates in the same manner as the controller shown in FIG. 1.

Now the switch 162 is set to the terminal c and a reset signal RS is passed to the flip-flop 161, a low level signal is passed to the AND-gate 6 and, as a consequence, no detection takes place. When the first practice of auto-repair operation starts after the resetting operation, the signal S2 is passed to the flip-flop 161 which thereupon passes a high level signal to the AND-gate 6 in order to initiate detection of the real increase in production time.

In the case of the foregoing embodiments, production time is employed as the production index indicative of the rate of production and the combination of the reference time oscillator 5 with the time counter 8 is used for measurement of time.

As a substitute, however, the number of weft insertions may be employed as the production index indicative of the rate of production. For example, a combination of an appropriate proximity switch with a pick counter can be used to this end. The proximity switch detects loom crank rotation to issue pick pulses which are counted at the pick counter. The count values at the pick counter are compared with a selected number of weft insertion.

Further, the length of cloth produced may be employed as the production index indicative of the rate of production. For example, a combination of a proper proximity switch with a length counter is usable to this end. The proximity switch detects rotation of a gear attached to the take-up roll to issue length pulses which are counted at the length counter. The count values at the length counter are compared with a selected length of cloth produced.

Further in case production time is employed as the production index indicative of the rate of production, counting of time may be started from the moment of formation of defects.

In accordance with the present invention, continued formation of serious weaving defects is automatically detected to prohibit further auto-repair operation, thereby fully avoiding degradation of the cloth being produced which is otherwise inevitably caused by enlargement of weaving defects. In particular, the controller in accordance with the present invention is advantageously applied to production under fully automatic control.

We claim:

1. A controller for controlling the operation of an auto-repair unit which corrects abnormal weaving operations on a loom, said controller comprising:

first detector means for generating detection signals indicative of an increase in a production index;

a first counter for counting said detection signals and issuing first count values as a function thereof;

first selector means for selecting a reference production index;

a first comparator for comparing said first count values to said selected reference production index and for issuing a reset signal when said first count value equals said selected reference production index, said first counter being reset by said reset signal;

second detector means for generating an auto-repair signal upon detection of each auto-repair operation;

a second counter for counting said auto-repair signals and for issuing second count values as a function thereof, said second counter being reset by said reset signal;

second selector means for selecting unacceptable auto-repair value; and a second comparator for comparing said second count values with said selected unacceptable auto-repair value in order to issue an alert signal for prohibiting further practice of auto-repair operation by said auto-repair unit when said second count value equals said selected unacceptable auto-repair value within said selected reference production index.

2. A controller for controlling the operation of an auto-repair unit which connects abnormal weaving operation on a loom, said controller comprising:

first detector means for generating detection signals indicative of an increase in a production index, a first counter for counting said detection signals and sequentially issuing first count values as a function thereof;

first selector means for selecting a reference production index;

a first comparator for comparing said first count values with a selected reference production index in order to issue a reset signal when said first count value equals said selected reference production index, said first counter being reset by said reset signal;

second detector means for generating an auto-repair signal upon detection of each auto-repair operation, a second counter for counting said auto-repair signals and issuing second count values as a function thereof, said second counter being reset by said reset signal from said first comparator;

second selector means for selecting an unacceptable auto-repair value;

a second comparator for comparing said second count values with said selected unacceptable auto-repair value in order to issue an alert signal for prohibiting further practice of an auto-repair operation by said auto-repair unit when said second count value equals said selected unacceptable auto-repair value within said selected reference production index; and means for controlling the input to said first counter such that said controlling means is reset, upon receipt of said reset signal from said first comparator, to bar input of said detection signals to said first counter, and set, upon receipt of said auto-repair signal from said second generating means, to allow input of said detection signals to said first counter.

3. A controller as claimed in claim 1 or 2 in which said first generating means generates a train of clock pulses indicative of real increase in production time; and said first selector means is a reference production time selector.

4. A controller as claimed in claim 1 or 2 in which said first generating means generates a train of length pulses indicative of real increase in length of cloth produced; and said first selector means is a reference length of cloth produced selector.

5. A controller as claimed in claim 1 or 2 in which said first generating means generates a train of pick pulses indicative of real increase in the number of weft insertions carried out by said loom said first selector means is a reference pick selector.

6. A controller for generating an alert signal which indicates that cloth being produced on a loom is of unacceptable quality, said controller comprising:

first means for detecting a production index which is indicative of the quality of cloth produced by a loom and for generating a first signal indicative thereof;

second means for detecting the fact that an automatic repair unit which automatically repairs weaving defects on said loom is repairing such a defect and for generating a second signal indicative thereof; and third means responsive to said first and second signals for generating an alert signal whenever the rate of automatic repair operations performed by said automatic repair unit exceeds a predetermined value.

7. The controller of claim 6, wherein said third means determines that said rate exceeds said predetermined value by determining if the number of automatic repair operations that occur within a predetermined production index exceeds a predetermined number.

8. The controller of claim 7, wherein said production index is the length of cloth produced by said loom.

9. The controller of claim 7, wherein said production index is the length of time said loom is actually weaving cloth.

10. The controller of claim 7, wherein said production index is the number off weft insertion operations carried out by said loom.

* * * * *